US005856270A

United States Patent [19]

Muto

[11] Patent Number: 5,856,270

[45] Date of Patent: Jan. 5, 1999

[54] THERMAL TRANSFER IMAGE-RECEIVING SHEET

[75] Inventor: Atsushi Muto, Shinjuku-ku, Japan

[73] Assignee: Dai Nippon Printing Co., Ltd., Japan

[21] Appl. No.: 891,207

[22] Filed: Jul. 10, 1997

[30] Foreign Application Priority Data

Jul. 15, 1996 [JP] Japan ..... 8-202739

[51] Int. Cl.[6] ..... B41M 5/035; B41M 5/38

[52] U.S. Cl. ..... 503/227; 428/195; 428/212; 428/213; 428/516; 428/913; 428/914

[58] Field of Search ..... 8/471; 428/195, 428/212, 213, 516, 913, 914; 503/227

[56] References Cited

FOREIGN PATENT DOCUMENTS

| | | | |
|---|---|---|---|
| 0 722 844 A1 | 7/1995 | European Pat. Off. | 503/227 |
| WO 90/02973 | 3/1990 | WIPO | 503/227 |

OTHER PUBLICATIONS

Patent Abstracts of Japan vol. 013, No. 229 (M–831), May 26, 1989 & JP 01 044781 A (Dai Nippon Printing co. Ltd). Feb. 17, 1989 *abstract*.

*Primary Examiner*—Bruce H. Hess
*Attorney, Agent, or Firm*—Parkhurst & Wendel, L.L.P.

[57] ABSTRACT

A thermal transfer image-receiving sheet which has excellent printability such as high printing sensitivity and which is not curled greatly when stored even in a high-temperature and/or high-humidity environment.

In the thermal transfer image-receiving sheet in which at least a coloring-material-receptive layer 2 (which will be the face of the image-receiving sheet), a resin layer 3 having minute voids, a support 4, and a backing layer 5 useful for preventing curling are successively laminated in the mentioned order, the backing layer is formed as a laminate of at least two layers 5*a* and 5*b* made from different resins. For instance, in the case where a polypropylene film having minute voids is used as the resin layer 3 having minute voids, it is preferable to form the backing layer 5 by the combination use of a polyethylene layer whose behavior in shrinkage is relatively similar to that of the polypropylene film having minute voids, especially a high-density polyethylene layer excellent in water vapor barrier characteristics, and a polypropylene layer excellent in thermal stability, by taking the balance between the total thickness of the layers provided on the surface of the support and the thickness of the backing layer into consideration.

6 Claims, 1 Drawing Sheet

THERMAL TRANSFER IMAGE-RECEIVING SHEET

TECHNICAL FIELD

The present invention relates to a thermal transfer image-receiving sheet on which an image is formed by thermally transferring a coloring material from a thermal transfer sheet superposed on the image-receiving sheet. More particularly, the present invention relates to a thermal transfer image-receiving sheet for use in a thermal transfer printing method utilizing a sublimable dye as a coloring material, capable of producing thereon a full-colored image with high density and high precision, showing high curling resistance even in a high-temperature and high-humidity environment.

BACKGROUND ART

Heretofore, among various thermal transfer recording methods, a heat-sensitive sublimation-type transfer printing method, and a heat-sensitive melt transfer printing method have been widely employed. The heat-sensitive sublimation-type transfer printing method is such that an image is produced, by the use of a heating device such as a thermal head whose heat generation is controlled according to image information, on a thermal transfer image-receiving sheet by transferring a sublimable dye, coloring material, contained in a sublimable dye layer provided on a thermal transfer sheet (dye donor sheet).

In this heat-sensitive sublimation-type transfer printing method, the amount of a dye to be transferred to form each dot can be controlled by the application of heat in an extremely short time. Further, a dye, which is excellent in transparency, is used as a coloring material, so that the image formed is very clear, and, at the same time, excellent in the reproducibility and gradation of half-tone. For this reason, there can be obtained, by this printing method, extremely precise images with high quality, comparable to full-colored images obtainable by photography using silver salts.

As a thermal transfer image-receiving sheet (hereinafter sometimes referred to as "image-receiving sheet") for use in such a heat-sensitive sublimation-type transfer printing method, a sheet prepared by forming a dye-receptive layer on a substrate sheet is generally used.

As the properties required for this image-receiving sheet, not only high printing sensitivity but also resistance to the curling of the image-receiving sheet itself (curling resistance) is important. For this reason, when the image-receiving sheet is prepared in sheet form, there has been adopted a method in which the curling of the image-receiving sheet is prevented by symmetrically providing a plastic sheet or the like on both surfaces of the substrate sheet such as a plastic sheet or paper, or a method in which curling resistance is imparted to the image-receiving sheet by providing a curling-preventing layer made from a resin or the like on the back surface of the substrate sheet.

In order to prevent curling, there has also been employed, for example, a method in which a polyethylene or polypropylene layer is provided on one surface (back surface) of a substrate, opposite to the surface on which a coloring-material-receptive layer is provided, or on both surfaces of a substrate. However, when the image-receiving sheets obtained by these methods are stored in a high-temperature or high-humidity environment, they can not always show satisfactory curling resistance. Specifically, in the case of an image-receiving sheet prepared by providing a polyethylene layer as the curling-preventing layer, although it shows excellent curling resistance when stored at high humidities, the degree of curl tends to be increased when it is stored at high temperatures. On the contrary, in the case of an image-receiving sheet prepared by providing a polypropylene layer as the curling-preventing layer, although it shows excellent curling resistance when stored at high temperatures, the degree of curl tends to be increased when it is stored at high humidities.

Further, in the case where a resin layer having minute voids is provided between a substrate and a coloring-material-receptive layer so as to obtain improved printing sensitivity, a method in which a resin layer having minute voids is provided also on the back surface of the substrate may be employed in order to prevent the curling of the image-receiving sheet. However, although the effect of preventing curling can be obtained by this method, the production cost is remarkably increased. For this reason, this method has been unsatisfactory from the economical point of view.

The present invention has been accomplished in view of the aforementioned background. An object of the present invention is therefore to provide an image-receiving sheet capable of showing excellent curling resistance even in a high-temperature or high-humidity environment although the back and face of the image-receiving sheet are not symmetrical in structure, by forming a layer useful for preventing curling, using a relatively inexpensive general-purpose resin on the back surface or both surfaces of a substrate which is the core of the image-receiving sheet.

DISCLOSURE OF THE INVENTION

We made earnest studies in order to solve the aforementioned problems, and, as a result, found the following: in an image-receiving sheet comprising a coloring-material-receptive layer (which will be the face of the image-receiving sheet), a resin layer having minute voids therein, a support, and a backing layer useful for preventing curling, which are successively laminated in the mentioned order, when the backing layer is made from a general-purpose resin and composed of a single layer, the image-receiving sheet cannot show sufficiently high curling resistance under the conditions of high temperatures, or of high temperatures and high humidities; however, when the backing layer is composed of two or more layers made from different resins, the image-receiving sheet can show excellent curling resistance even under severe conditions. The present invention has been accomplished on the basis of this finding.

Namely, a thermal transfer image-receiving sheet of the present invention comprises a support, a resin layer provided on one surface of the support, the resin layer having minute voids therein, a coloring-material-receptive layer provided on the resin layer, and a backing layer provided on the other surface of the support, wherein the backing layer is a laminate composed of two or more layers made from resins of different types.

In a preferable embodiment of the present invention, the backing layer is a laminate of a high-density polyethylene layer and a polypropylene layer.

BEST MODE FOR CARRYING OUT THE INVENTION

By referring now to the accompanying drawings, materials, a method of fabrication and the like to be used for producing a thermal transfer image-receiving sheet of the present invention will be explained.

Figure 1:
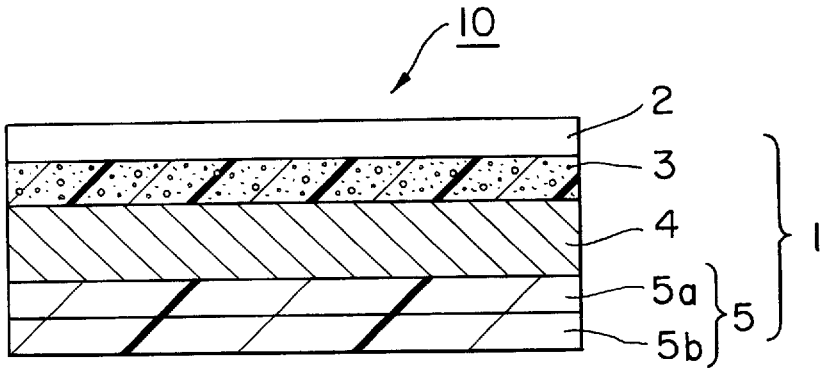
FIG. 1 is a diagrammatical cross-sectional view showing the structure of one embodiment of the thermal transfer image-receiving sheet of the present invention.
Figure 2:
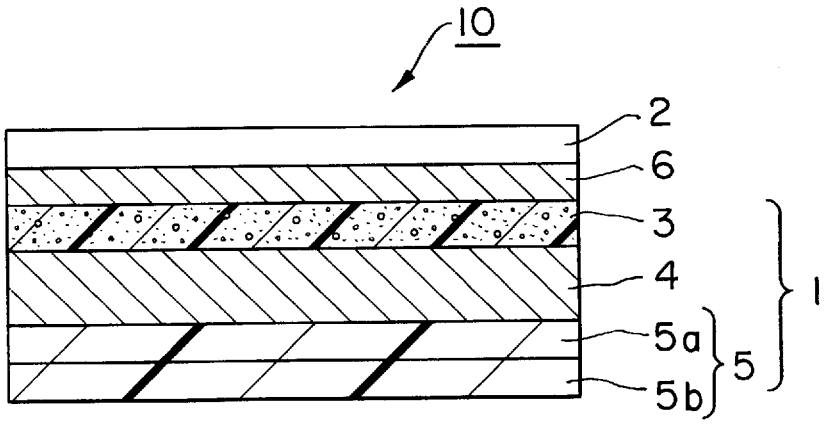
FIG. 2 is a diagrammatical cross-sectional view showing the structure of another embodiment of the thermal transfer image-receiving sheet of the present invention.

FIGS. 1 and 2 are diagrammatical cross-sectional views respectively showing the structures of embodiments of the thermal transfer image-receiving sheet of the present invention. It is noted that the structure of the thermal transfer image-receiving sheet of the present invention is not limited to the structures shown in these two figures.

In the drawings, the numerals in the different views identify identical parts.

FIG. 1 shows the structure of a thermal transfer image-receiving sheet 10, in which a coloring-material-receptive layer 2 capable of receiving a coloring material such as a dye to form an image by means of thermal transfer printing is provided on one surface of a substrate sheet 1. The substrate sheet 1 is a laminate of at least three layers (strictly speaking, five or more layers), that is, a resin layer 3 having minute voids, a support 4, and a backing layer 5 useful for preventing curling (consisting of at least two layers 5*a* and 5*b*), these layers being successively laminated in the mentioned order from the coloring-material-receptive layer 2 side.

FIG. 2 shows the structure of a thermal transfer image-receiving sheet 10 obtainable by further providing, to the thermal transfer image-receiving sheet of the structure shown in FIG. 1, an intermediate layer 6 between the substrate sheet 1 and the coloring-material-receptive layer 2, specifically between the resin layer 3 having minute voids contained in the substrate sheet 1 and the coloring-material-receptive layer 2.

This intermediate layer 6 is an optional layer to be provided when necessary; and it is possible to form this layer by the use of a material freely selected depending upon the purpose of the layer, or by the combination use of such materials. For instance, when the adhesion between the resin layer 3 having minute voids and the coloring-material-receptive layer 2 is weak, a resin layer useful for improving the adhesion may be provided as the intermediate layer. In the case where the whiteness of the substrate sheet 1 is insufficient, a white resin layer obtainable by adding a white pigment or the like to the binder thereof may be provided as the intermediate layer. A layer composed of these two layers can also be used.

In addition, although not shown in the figures, an adhesive resin layer may be provided, when necessary, between the support 4 and the resin layer 3 having minute voids, or between the support 4 and the backing layer 5 by using an adhesive agent, or a resin capable of improving adhesiveness.

Thus, the thermal transfer image-receiving sheet 10 of the present invention is basically composed of a coloring-material-receptive layer 2 (which will be the face of the image-receiving sheet), a resin layer 3 having minute voids, a support 4, and a backing layer 5 (consisting of two or more layers). With respect to the individual layers, explanations will be given below.

Coloring-Material-Receptive Layer

The coloring-material-receptive layer 2 is to receive a coloring material such as a sublimable dye which is transferred from a thermal transfer sheet, and to maintain the image thus formed. In general, the coloring-material-receptive layer 2 is formed by dissolving or dispersing materials for the receptive layer 2 in a solvent to obtain a coating liquid, and coating this coating liquid onto the surface of a substrate sheet. The coating liquid is therefore a solution containing as its main component a resin capable of being dyed with a dye, into which various additives such as a lubricant are added, as needed. The coloring-material-receptive layer 2 itself may be any conventional one which is used in a sublimation-type thermal transfer printing method.

Examples of the resin capable of being dyed with a dye include known resins such as polyester resins, polyurethane resins, polycarbonate resins, acrylic resins such as polyacrylate, polyvinyl chloride, polyvinyl acetate, polyvinyl butyral, vinyl chloride-vinyl acetate copolymers and polyamides; copolymers thereof; and mixtures thereof. Of these, polyester resins and vinyl chloride-vinyl acetate copolymers are particularly preferred.

Further, besides the above-described resin, a lubricant may be added to the coloring-material-receptive layer 2 in order to prevent the receptive layer 2 from being thermally fused with a thermal transfer sheet when thermal transfer printing is conducted. Examples of the lubricant include phosphoric esters, metallic soaps, fluorine compounds, and silicone oils.

Of these, silicone oils are particularly preferred, and, for instance, dimethyl silicone, or various modified silicones can be used.

Among various modified silicones, amino-modified silicone, epoxy-modified silicone, alcohol-modified silicone, vinyl-modified silicone and urethane-modified silicone can be used. Mixtures of these modified silicones, or polymers obtainable from these modified silicones by using various reactions can also be used. Such a reactive silicone oil may be added to the coloring-material-receptive layer 2 in an amount of preferably from 0.1 to 20% by weight of the receptive layer.

As mentioned previously, the coloring-material-receptive layer 2 is formed, in general, by coating a solution, and drying the solution coated. There is no particular limitation on the coating method, and any conventional coating method such as roll coating, gravure coating, gravure-reverse coating, or bar coating method can be employed.

The amount of a solution to be coated so as to form the coloring-material-receptive layer 2 is, in general, from 0.5 to 10 $g/m^2$ on dry basis.

Intermediate Layer

As briefly mentioned in the explanation of the thermal transfer image-receiving sheet 10 shown in FIG. 2, an intermediate layer 6 may be provided, if necessary, between the resin layer 3 having minute voids, contained in the substrate sheet 1, and the coloring-material-receptive layer 2. This intermediate layer 6 may be formed by suitably selecting materials depending upon its purpose, and by any suitable method.

For instance, when the adhesion between the coloring-material-receptive layer 2, and the resin layer 3 having minute voids contained in the substrate sheet 1 is insufficient, a primer coat layer can be provided, as the intermediate layer 6, by coating a polyurethane or chlorinated polypropylene solution onto the adhered surfaces of the coloring-material-receptive layer 2 and of the resin layer 3 which have been pre-treated by corona discharge treatment or ozone treatment. Alternatively, an adhesive resin layer may be provided as the intermediate layer 6 by extrusion-coating a resin capable of improving adhesiveness, such as a modified polyolefin.

Further, in the case where the whiteness of the substrate sheet 1 is insufficient, a white resin layer obtainable by adding a known white pigment or fluorescent whitening agent such as titanium oxide, calcium carbonate or barium sulfate to the above-described adhesive resin can be provided as the intermediate layer 6.

Furthermore, when antistatic properties are required, it is possible to add an antistatic agent to the intermediate layer 6. Any intermediate layer 6 capable of meeting a plurality of purposes can be provided by the combination use of materials suitable for respective purposes.

It is preferable that the thickness of the intermediate layer 6 be approximately 0.5 to 30 micrometers.

Resin Layer Having Minute Voids

In the thermal transfer image-receiving sheet 10 of the present invention, a resin layer 3 having minute voids is provided between the support 4 and the coloring-material-receptive layer 2 in order to impart cushioning properties to the image-receiving sheet 10, to obtain a printed image free from void and unevenness in density, and to further improve the printing sensitivity.

This resin layer 3 having minute voids may be provided by laminating a plastic film containing therein minute voids, or synthetic paper having minute voids to the support 4. Alternatively, it may be formed by coating a dispersion of hollow microspheres or thermally-expandable microspheres in a binder onto the surface of the support 4, and drying the dispersion coated, or coating the dispersion, drying the dispersion coated, and expanding the dried layer. In this case, one of, or two or more of known resins such as urethane resins, acrylic resins, polyesters, polyvinyl chloride, polyvinyl acetate and polycarbonates can be used as the binder.

The above-described plastic film or synthetic paper having minute voids include those ones which contain as a main component thereof polypropylene or polyester. Polyester-based ones are inferior to polypropylene-based ones in cushioning properties and heat-insulating properties due to the viscoelasticity or thermal performance of polyesters. Therefore, in order to improve the printing sensitivity and to obtain images free from unevenness in density and void, a polypropylene-based plastic film or synthetic paper is preferably used as the resin layer 3 having minute voids.

In the light of the above-described points, it is preferable that the modulus of elasticity at 20° C. of the plastic film or synthetic paper having minute voids be in the range of $5\times10^{8}$ to $1\times10^{10}$ Pa.

The plastic film and synthetic paper are generally produced by means of biaxial orientation. Therefore, even after they are thermally fixed, they still have heat shrinkability to some extent. For instance, when they are allowed to stand at 110° C. for 60 seconds, they shrink in 0.5 to 2.5%.

The above-described plastic film or synthetic paper may be a single layer having minute voids in itself; or it may be composed of a plurality of layers. In the latter case, it is acceptable that either all of or only some of the layers have minutes voids. Further, it is possible to add additives such as white pigments or fluorescent whitening agents to the plastic film or synthetic paper, when necessary.

It is preferable that the thickness of the resin layer 3 having minute voids be in the range of 30 to 80 micrometers.

Support

In the thermal transfer image-receiving sheet 10 of the present invention, various types of papers or synthetic papers such as high quality paper, coated paper, art paper, cast-coated paper, glassine paper and resin-impregnated paper; non-woven fabrics; and films or sheets of plastics such as polyethylene terephthalate, acrylic resins, polyethylene and polypropylene can be used as the support 4 serving as the core of the image-receiving sheet. These materials can be used either singly or as a laminate of two or more layers.

Backing Layer

The backing layer 5 provided on the back surface of the support 4, opposite to the surface on which the resin layer 3 having minute voids, and the coloring-material-receptive layer 2 are provided, is to improve the curling resistance of the image-receiving sheet 10. This layer is characteristic of the present invention.

When a sheet prepared by laminating the support 4 with the resin layer 3 having minute voids, and providing the coloring-material-receptive layer 2 on the resin layer 3 is used as it is as the image-receiving sheet 10, inherent curl in the image-receiving sheet 10 is observed, or curl is developed while the image-receiving sheet 10 is preserved in a certain environment because the surface and the back surface of the support 4 are asymmetrical in structure. Therefore, the image-receiving sheet cannot be smoothly carried in a thermal printer.

For this reason, it is necessary to provide a curling-preventing layer on the back surface of the support 4, thereby minimizing the cause of curling.

In general, in order to prevent curling, it is effective to balance the shrinkage in the surface of the support 4 with that in the back surface of the same, by providing layers on both surfaces of the support symmetrically or almost symmetrically in terms of material and thickness. For instance, it is possible to provide a resin layer having minute voids, which is the same or almost the same as the resin layer provided on the coloring-material-receptive layer side, on the back surface of the support. Alternatively, it is possible to provide, on the back surface of the support, a resin layer which is similar to the resin layer provided on the other side but has no minute voids.

However, in the case of an image-receiving sheet in which a plastic film having minute voids is laminated to the surface of the support 4 on the coloring-material-receptive layer 2 side, it is disadvantageous, from the economical point of view, that is, when the cost of materials and that of production are taken into consideration, to provide the same plastic film having minute voids also on the other surface (back surface) of the support 4 in order to simply impart curling resistance to the image-receiving sheet. Moreover, there may be a case where the resulting image-receiving sheet becomes poor in appearance.

When a resin layer having no minute voids, made from a material which is the same as or similar to the material for the resin layer 3 having minute voids, provided on the surface of the support 4 is provided on the back surface of the support 4, the economic problem can be solved. However, in this image-receiving sheet, the layers provided on the surface and the back surface of the support 4 are asymmetrical in structure. Therefore, although this image-receiving sheet is not curled when preserved at room temperature, it is curled greatly, and cannot show sufficiently high curling resistance when preserved at high temperatures and/or high humidities.

Therefore, in the present invention, the backing layer 5 useful for preventing curling is formed as a laminate composed of at least two layers 5*a* and 5*b* made from different resins having different physical properties, and the proportion of the thickness of the resin layer 3 having minute voids to that of the backing layer 5, and the proportion of the thickness of the layer 5*a* to that of the layer 5*b* are so controlled that they can fall in specific ranges. A thermal transfer image-receiving sheet which can show excellent curling resistance although the layers provided on the surface and the back surface of the support are asymmetrical in structure and which brings about no economic problem can thus be obtained.

A resin suitable for forming the backing layer 5 which is provided on the back surface of the support 4 varies basically depending upon the materials, especially the behavior in shrinkage of the materials which are used for forming the layers provided on the surface of the support 4. However, those materials which have water vapor barrier characteristics and which scarcely shrink due to heat or moisture are preferred.

A polypropylene-based plastic film having therein minute voids is often used as the resin layer 3 having minute voids, which is provided on the surface of the support 4. In this case, it is preferable to use, as the resin for forming the backing layer 5, a polyolefin resin such as polypropylene (PP) or polyethylene (PE), having physical properties relatively similar to those of the resin used for forming the resin layer 3. Among polyethylene resins, high-density polyethylene (HDPE), which is excellent in thermal stability, is more preferable than low-density polyethylene (LDPE).

Therefore, for instance, in a case where paper such as coated paper is used as the support 4 and where the backing layer 5 is formed as a laminate of two layers (5*a*, 5*b*) made from different resins, an HDPE layer is preferably used as the first layer 5*a*, and a PP layer is preferably used as the second layer 5*b*. Further, it is preferable to incorporate an ethylene-alpha-olefin copolymer into the HDPE layer in an amount of 15 to 20% by weight in order to improve the adhesion between the HDPE layer and the paper used as the support, and the adhesion between the HDPE layer and the PP layer used as the second layer.

In addition, it is preferable that the thickness of the above-described backing layer 5, that is, the total thickness of the HDPE layer 5*a* and the PP layer 5*b*, be in the range of 80 to 120% of the thickness of the resin layer 3 having minute voids provided on the surface of the support because excellent curling resistance can be obtained in this case. Further, with respect to the thickness of the HDPE layer 5*a* and that of the PP layer 5*b*, it is preferable that the thickness of the HDPE layer 5*a* be in the range of 50 to 90% of the thickness of the PP layer 5*b* because excellent curling resistance can be obtained in this case.

There is no particular limitation on the method for laminating the backing layer 5, that is, the HDPE layer 5*a* and the PP layer 5*b*, to the back surface of the support 4, and any method selected from known methods of lamination can be used. Specifically, one of the following methods can be used.

(1) A method in which an HDPE film and a PP film, each having a predetermined thickness, are respectively prepared, and these films are successively laminated by a known means such as a dry lamination method, or a sandwich lamination method using an adhesive resin.

(2) A method in which a film having a predetermined thickness is prepared by co-extruding HDPE and PP, and laminated to a support by a known means such as a dry lamination method, or a sandwich lamination method using an adhesive resin.

(3) A method in which an HDPE layer and a PP layer, each having a predetermined thickness, are successively laminated to a support by means of extrusion coating.

(4) A method in which a layer having a predetermined thickness is provided on a support by co-extruding HDPE and PP.

Among the above-described methods of lamination, the method (4), which is most excellent in productivity, is preferred when economical efficiency is taken into consideration.

The present invention will now be explained more specifically by referring to the following Examples and Comparative Examples. However, the following Examples should not be construed as limiting the present invention.

EXAMPLE 1

Coated paper with a US basis weight of 157 g/m$^2$("NK High Coat" manufactured by Nippon Kakoh Seishi Co., Ltd., Japan) was used as the support of an image-receiving sheet. One surface of this paper was subjected to corona discharge treatment, and on this surface was provided a backing layer 5 in the following manner: high-density polyethylene (hereinafter referred to as "HDPE") ("J-lex LZ 0139-2" manufactured by Japan Polyolefins Co., Ltd., density=0.952 g/cm$^3$) containing 15% by weight of an ethylene-alphaolefin copolymer ("Tafmer A-4085" manufactured by Mitsui Petrochemical Industries, Ltd., Japan), and polypropylene (hereinafter referred to as "PP") ("J-aromer LR 711-5" manufactured by Japan Polyolefins Co., Ltd., density=0.905 g/cm$^3$) were co-extrusion-coated onto the treated surface of the paper in an ordinary manner by using a multiple T-die so that the HDPE layer would be in contact with the paper.

The outer surface of the PP Layer was subjected to corona discharge treatment so that a slippery backing layer can further be provided, if necessary, on this surface.

The extrusion coating was conducted so that the thickness of the HDPE layer containing the ethylene-alpha-olefin copolymer, and that of the PP layer would be 14 micrometers and 19 micrometers, respectively. The total thickness of the backing layer was therefore 33 micrometers.

On the other hand, a foamed polypropylene sheet having a thickness of 35 micrometers ("35 MW 846" manufactured by Mobil Plastics Europe Co., Ltd.) was used as the resin layer having minute voids. A coating liquid for forming an intermediate layer, having the following composition was coated onto one surface of this sheet in an amount of 1.5 g/m$^2$ (dry basis) by a gravure-reverse coating method, and then dried. A coating liquid for forming a coloring-material-receptive layer, having the following composition was then coated onto the intermediate layer in an amount of 4.0 g/m$^2$ (dry basis) by a gravure-reverse coating method, and then dried. Thus, a foamed PP sheet laminated with the intermediate layer and the coloring-material-receptive layer was obtained.

Next, the above-obtained foamed PP sheet and the firstly-prepared support were adhered to each other by a dry lamination method using an adhesive agent having the following composition, provided that the surface of the foamed PP sheet, on which the intermediate layer and the coloring-material-receptive layer were not provided, was faced the surface of the support, on which the backing layer was not provided. Thus, a thermal transfer image-receiving sheet of the present invention was prepared.

Structure of Image-Receiving Sheet

Coloring-material-receptive layer (4.0 g/m$^2$)/Intermediate layer (1.5 g/m$^2$)/Foamed PP sheet (35 micrometers)/

Adhesive agent (4.0 g/m$^2$)/Coated paper (157 g/m$^2$)/Backing layer: HDPE layer ("J-lex LZ 0139-2" containing 15% by weight of "Tafmer A-4085") (14 micrometers)+PP layer ("J-aromer LR 711-5") (19 micrometers)

It is noted that the total thickness of this image-receiving sheet is 200 micrometers.

| | |
|---|---|
| (Composition of Coating Liquid for Forming Intermediate Layer) | |
| Urethane resin ("Nippollan 5199" manufactured by Nippon Polyurethane Industry Co., Ltd., Japan) | 5.7 parts by weight |
| Titanium oxide ("TCA 888" manufactured by TOHKEM PRODUCTS CORPORATION, Japan) | 11.4 parts by weight |
| Fluorescent whitening agent ("Ubitex OB" manufactured by Ciba-Geigy Japan Limited) | 0.2 parts by weight |
| Isocyanate ("Takenate A-14" manufactured by Takeda Chemical Industries, Ltd., Japan) | 2.0 parts by weight |
| Solvents: | |
| Methyl ethyl ketone | 15.5 parts by weight |
| Toluene | 15.5 parts by weight |
| Isopropyl alcohol | 7.7 parts by weight |
| (Composition of Coating Liquid for Forming Coloring-Material-Receptive Layer) | |
| Vinyl chloride-vinyl acetate copolymer ("Denka Vinyl #1000A" manufactured by Denki Kagaku Kogyo K.K., Japan) | 7.2 parts by weight |
| Vinyl chloride-styrene-acryl copolymer ("Denkalak #400" manufactured by Denki Kagaku Kogyo K.K., Japan) | 1.6 parts by weight |
| Polyester ("Vylon 600" manufactured by Toyobo Co., Ltd., Japan) | 11.2 parts by weight |
| Vinyl-modified silicone ("X-62-1212" manufactured by Shin-Etsu Chemical Co., Ltd., Japan) | 2.0 parts by weight |
| Catalysts: | |
| "CAT PLR-5" manufactured by Shin-Etsu Chemical Co., Ltd., Japan | 1.0 part by weight |
| "CAT PL-50T" manufactured by Shin-Etsu Chemical Co., Ltd., Japan | 1.2 parts by weight |
| Solvents: | |
| Methyl ethyl ketone | 39.0 parts by weight |
| Toluene | 39.0 parts by weight |
| (Composition of Adhesive Agent) | |
| Polyfunctional polyol ("Takelak A-969V" manufactured by Takeda Chemical Industries, Ltd., Japan) | 30.0 parts by weight |
| Isocyanate ("Takenate A-5" manufactured by Takeda Chemical Industries, Ltd., Japan) | 10.0 parts by weight |
| Solvent: Ethyl acetate | 60.0 parts by weight |

EXAMPLE 2

The procedure of the Example 1 was repeated except that the resin used in Example 1 for forming the HDPE layer in the backing layer was replaced by "Mitsubishi Polyethylene L 0581" (density=0.942 g/cm$^3$) manufactured by Mitsubishi Petrochemical Co., Ltd., Japan, thereby obtaining a thermal transfer image-receiving sheet.

Structure of Image-Receiving Sheet

Coloring-material-receptive layer (4.0 g/cm$^2$)/Intermediate layer (1.5 g/m$^2$)/Foamed PP sheet (35 micrometers)/Adhesive agent (4.0 g/m$^2$)/Coated paper (157 g/m$^2$)/Backing layer: HDPE layer ("Mitsubishi Polyethylene L 0581" containing 15% by weight of "Tafmer A-4085") (14 micrometers)+PP Layer ("J-aromer LR 711-5") (19 micrometers)

It is noted that the total thickness of this image-receiving sheet is 200 micrometers.

COMPARATIVE EXAMPLE 1

The procedure of Example 1 was repeated except that a single layer having a thickness of 33 micrometers was provided as the backing layer by extrusion-coating medium-density polyethylene (MDPE), "Sumikasen L5721" (density=0.938 g/cm$^3$) manufactured by Sumitomo Chemical Co., Ltd., Japan, thereby obtaining a comparative thermal transfer image-receiving sheet.

Structure of Image-Receiving Sheet

Coloring-material-receptive layer (4.0 g/cm$^2$)/Intermediate layer (1.5 g/m$^2$) /Foamed PP sheet (35 micrometers)/Adhesive agent (4.0 g/m$^2$)/Coated paper (157 g/m$^2$)/Backing layer: MDPE layer ("Sumikasen L5721") (33 micrometers)

It is noted that the total thickness of this image-receiving sheet is 200 micrometers.

COMPARATIVE EXAMPLE 2

The procedure of Example 1 was repeated except that a single layer having a thickness of 40 micrometers was provided as the backing layer by extrusion-coating PP, "J-aromer LR 711-5" manufactured by Japan Polyolefins Co., Ltd., thereby obtaining a comparative thermal transfer image-receiving sheet.

Structure of Image-Receiving Sheet

Coloring-material-receptive layer (4.0 g/cm$^2$)/Intermediate layer (1.5 g/m$^2$)/Foamed PP sheet (35 micrometers)/Adhesive agent (4.0 g/m$^2$)/Coated paper (157 g/m$^2$)/Backing layer: PP layer ("J-aromer LR 711-5") (40 micrometers)

It is noted that the total thickness of this image-receiving sheet is 207 micrometers.

COMPARATIVE EXAMPLE 3

The procedure of Example 1 was repeated except that a single layer having a thickness of 33 micrometers was provided as the backing layer by extrusion-coating a mixture of polyethylene, "J-lex LZ 0139-2" (density=0.952 g/cm$^3$) manufactured by Japan Polyolefins Co., Ltd., and PP, "J-aromer LR 711-5" (density=0.905 g/cm$^3$) manufactured by Japan Polyolefins Co., Ltd., the mixing ratio of the polyethylene to the PP being 45:55 (weight basis), thereby obtaining a comparative thermal transfer image-receiving sheet.

Structure of Image-Receiving Sheet

Coloring-material-receptive layer (4.0 g/cm$^2$)/Intermediate layer (1.5 g/m$^2$)/Foamed PP sheet (35 micrometers)/Adhesive agent (4.0 g/m$^2$)/Coated paper (157 g/m$^2$)/Backing layer: layer of a mixture of polyethylene and PP (a mixture of "J-lex LZ 0139-2" and "J-aromer LR 711-5") (33 micrometers)

It is noted that the total thickness of this image-receiving sheet is 200 micrometers.

Evaluation and Results

The thermal transfer image-receiving sheets obtained in Examples 1 and 2, and Comparative Examples 1, 2 and 3 were evaluated in terms of curling resistance by the following methods. The results are shown in Table 1.

(1) Measurement of Degree of Curl

The thermal transfer image-receiving sheets obtained in Examples 1 and 2, and Comparative Examples 1, 2 and 3 were respectively cut in "size A6", and 200 sheets of each image-receiving sheet were preserved under each of the following conditions for 100 hours: (1) at room temperature (25° C.) and 60% RH; (2) at 40° C. under a dried atmosphere; (3) at 60° C. under a dried atmosphere; and (4) at 40° C. and 90% RH. Thereafter, 10 sheets were randomly sampled from each group. Each sheet was placed on a horizontal plate so that the coloring-material-receptive layer would face the plate surface, and the distance between the plate and the portion of the curled sheet farthest from the plate was measured (unit: mm). The degree of curl, expressed by the average distance, is shown in Table 1.

In order to indicate the direction of curl, the degree of curl is shown in the table with the symbol "+" or "−", where "+" means curl with the coloring-material-receptive layer bulged, and "−" means curl with the coloring-material-receptive layer depressed.

(2) Evaluation of Curl

It is preferable that an image-receiving sheet be free from curl and be flat (the degree of curl=0). Practically, however, when the degree of curl in the direction of "+" is in excess of 10 mm, the image-receiving sheet cannot be smoothly carried in a thermal printer; and when the degree of curl in the direction of "−" is in excess of 5 mm (the absolute value), the image-receiving sheet cannot be smoothly carried in a thermal printer.

Therefore, the evaluation of curl is conducted according to the following standard, and the results are shown in Table 1:

0 (suitable): the degree of curl is from 0 to +10.0 mm, or from 0 to −5.0 mm, and X (unsuitable): the degree of curl is +10.1 mm or more, or, in the case of "−" curl, the absolute value of the degree of curl is 5.1 mm or more.

TABLE 1

(Results of Evaluation)
[Degree of Curl (unit:mm)]

| | Preserved at room temperature and 60% RH Degree of Curl/Judgement | | Preserved at 40° C. under a dried atmosphere Degree of Curl/Judgement | | Preserved at 60° C. under a dried atmosphere Degree of Curl/Judgement | | Preserved at 40° C. and 90% RH Degree of Curl/Judgement | |
|---|---|---|---|---|---|---|---|---|
| Example 1 | +3.2 | ○ | +6.9 | ○ | +3.9 | ○ | +2.1 | ○ |
| Example 2 | +2.3 | ○ | +5.0 | ○ | −1.8 | ○ | −2.4 | ○ |
| Comparative Example 1 | +4.0 | ○ | +15.0 | X | +10.0 | ○ | +3.0 | ○ |
| Comparative Example 2 | +1.0 | ○ | +6.0 | ○ | +6.0 | ○ | −9.0 | X |
| Comparative Example 3 | +3.3 | ○ | +11.5 | X | +8.5 | ○ | +3.2 | ○ |

As is clear from the results shown in Table 1, the thermal transfer image-receiving sheets obtained in Examples 1 and 2, in which a laminate of an HDPE layer and a PP layer was used as the backing layer, showed low degrees of curl under all of the preservation conditions. Moreover, they were carried in a thermal printer without causing any trouble.

On the contrary, the thermal transfer image-receiving sheet obtained in Comparative Example 1 was greatly curled in the "+" direction when preserved especially at 40° C. under a dried atmosphere; and the thermal transfer image-receiving sheet obtained in Comparative Example 2 was greatly curled in the "−" direction when preserved at 40° C. and a high relative humidity of 90%. It was impossible to smoothly carry these image-receiving sheets in a thermal printer. The thermal transfer image-receiving sheet obtained in Comparative Example 3 was superior to the image-receiving sheets obtained in Comparative Examples 1 and 2. However, the degree of "+" curl obtained after the image-receiving sheet was preserved at 400° C. under a dried atmosphere was in excess of the suitable range. Thus, this image-receiving sheet was clearly inferior to the image-receiving sheets obtained in Examples 1 and 2.

As explained above in detail, in a thermal transfer image-receiving sheet of the present invention in which at least a coloring-material-receptive layer (which will be the face of the image-receiving sheet), a resin layer having minute voids, a support and a backing layer useful for preventing curling are successively laminated in the mentioned order, the backing layer is provided as a laminate of at least two layers made from different resins.

Since the backing layer is composed of a plurality of layers made from different resins, the layers can complement each other their shortcomings, and the shrinkage in the image-receiving sheet due to heat or moisture can thus be prevented. Therefore, the image-receiving sheet of the present invention is not curled greatly, and shows excellent curling resistance when it is stored even under severe environmental conditions, for example, when it is stored at high temperatures, or at high temperatures and high humidities. In addition, the image-receiving sheet of the present invention shows high printing sensitivity when thermal transfer printing is conducted, and can produce images free from void and unevenness in density.

Further, in the case where the backing layer is composed of a high-density polyethylene layer and a polypropylene layer, the adhesion between the polyethylene layer and the support and/or the polypropylene layer can be improved by incorporating an ethylene-alpha-olefin copolymer into the polyethylene layer in an amount of 15 to 20% by weight. Furthermore, when the backing layer is so provided on the back surface of the support that the thickness of the high-density polyethylene layer will be from 50 to 90% of the thickness of the polypropylene layer, and that the total thickness of the polyethylene layer and the polypropylene layer will be from 80 to 120% of the thickness of the resin layer having minute voids provided on the other surface of the support, the curling resistance can be further improved.

In addition, when the backing layer is formed by a co-extrusion method, the productivity is increased, and the production cost is decreased. This method is therefore advantageous in that a thermal transfer image-receiving sheet can be economically obtained.

I claim:

1. A thermal transfer image-receiving sheet comprising:

a support;

a resin layer provided on one surface of the support, the resin layer having minute voids therein;

a coloring-material-receptive layer provided on the resin layer; and a backing layer provided on the other surface of the support, the backing layer comprising a laminate of two or more layers made from resins of different types.

2. The thermal transfer image-receiving sheet according to claim 1, wherein the backing layer is a laminate of a high-density polyethylene layer and a polypropylene layer.

3. The thermal transfer image-receiving sheet according to claim 2, wherein the high-density polyethylene layer contains 15 to 20% by weight of an ethylene-alpha-olefin copolymer.

4. The thermal transfer image-receiving sheet according to claim 2, wherein the thickness of the high-density polyethylene layer is from 50 to 90% of the thickness of the polypropylene layer.

5. The thermal transfer image-receiving sheet according to claim 1, wherein the thickness of the backing layer is from 80 to 120% of the thickness of the resin layer having minute voids.

6. The thermal transfer image-receiving sheet according to claim 1, wherein the backing layer is a laminate obtained by a co-extrusion method.

* * * * *

UNITED STATES PATENT AND TRADEMARK OFFICE

CERTIFICATE OF CORRECTION

PATENT NO. : 5,856,270

DATED : January 5, 1999

INVENTOR(S) : Atsushi MUTO

It is certified that error appears in the above-indentified patent and that said Letters Patent is hereby corrected as shown below:

Title page, item, [22] Filed: change "July 10,1997" to --July 11, 1997--.

Signed and Sealed this

Twenty-first Day of March, 2000

*Attest:*

*Attesting Officer*

Q. TODD DICKINSON

*Commissioner of Patents and Trademarks*